US009741519B2

(12) United States Patent
Castro Maciel et al.

(10) Patent No.: US 9,741,519 B2
(45) Date of Patent: Aug. 22, 2017

(54) LOCKOUT RELAY DEVICE

(71) Applicant: Schweitzer Engineering Laboratories, Inc., Pullman, WA (US)

(72) Inventors: Carlos Baltazar Castro Maciel, Soledad de Graciano Sanchez (MX); Marco Antonio Hidrogo Ordaz, Gomez Palacio (MX); Gerardo Rodriguez Najera, San Nicolas de los Garza (MX); Sergio David Esquivel Alvarez, Valle de Campestre (MX); Jose Ramon Martinez Ramirez, San Luis Potosi (MX); Hector Jaime Alba, San Luis Potosi (MX); Jorge Luis Soto Murrieta, San Luis Potosi (MX)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 0 days.

(21) Appl. No.: 15/407,460

(22) Filed: Jan. 17, 2017

(65) Prior Publication Data

US 2017/0207053 A1 Jul. 20, 2017

Related U.S. Application Data

(63) Continuation of application No. 15/000,485, filed on Jan. 19, 2016, now Pat. No. 9,653,244.

(51) Int. Cl.

| | |
|---|---|
| ***H01H 71/68*** | (2006.01) |
| ***H01H 71/10*** | (2006.01) |
| ***H01H 71/50*** | (2006.01) |
| ***H01H 50/16*** | (2006.01) |
| ***H01H 50/64*** | (2006.01) |

(52) U.S. Cl.

CPC ..... *H01H 71/10* (2013.01); *H01H 50/16* (2013.01); *H01H 50/641* (2013.01); *H01H 71/50* (2013.01)

(58) Field of Classification Search

CPC ..... H01H 71/66–71/70

See application file for complete search history.

(56) References Cited

U.S. PATENT DOCUMENTS

| | | | |
|---|---|---|---|
| 3,649,793 | A | 3/1972 | MacLean |
| 4,001,740 | A | 1/1977 | MacLean |
| 4,399,421 | A | 8/1983 | MacLean |
| 5,762,180 | A | 6/1998 | Pomatto |
| 6,015,958 | A | 1/2000 | Pomatto |

*Primary Examiner* — Ramon M Barrera

(74) *Attorney, Agent, or Firm* — Jared L. Cherry

(57) ABSTRACT

This disclosure relates to various embodiments of lockout relay devices. In one embodiment, a lockout relay device may transition between a closed position and a lockout position in response to an action of a deck device. The lockout relay may further be configured to transition from the lockout position to the closed position only in response to one of a manual adjustment and a reset operation. A manual actuator may permit a manual transition of the lockout relay device from the closed position to the lockout position and from the lockout position to the closed position. The lockout relay device may remain in the lockout position until the occurrence of one of a manual adjustment and a reset operation.

20 Claims, 7 Drawing Sheets

LOCKOUT RELAY DEVICE

RELATED APPLICATIONS

This application is a continuation of U.S. patent application Ser. No. 15/000,485, filed on Jan. 19, 2016, and titled "Lockout Relay Device," which is incorporated herein by reference in its entirety.

TECHNICAL FIELD

This disclosure relates to various embodiments of lockout relay devices that may be utilized in a variety of applications. More particularly but not exclusively, this disclosure relates to lockout relay devices that may be used to trip and lockout one or more deck devices in response to a fault or other condition.

BRIEF DESCRIPTION OF THE DRAWINGS

Non-limiting and non-exhaustive embodiments of the disclosure are described, including various embodiments of the disclosure with reference to the figures, in which.

DETAILED DESCRIPTION

Figure 1:
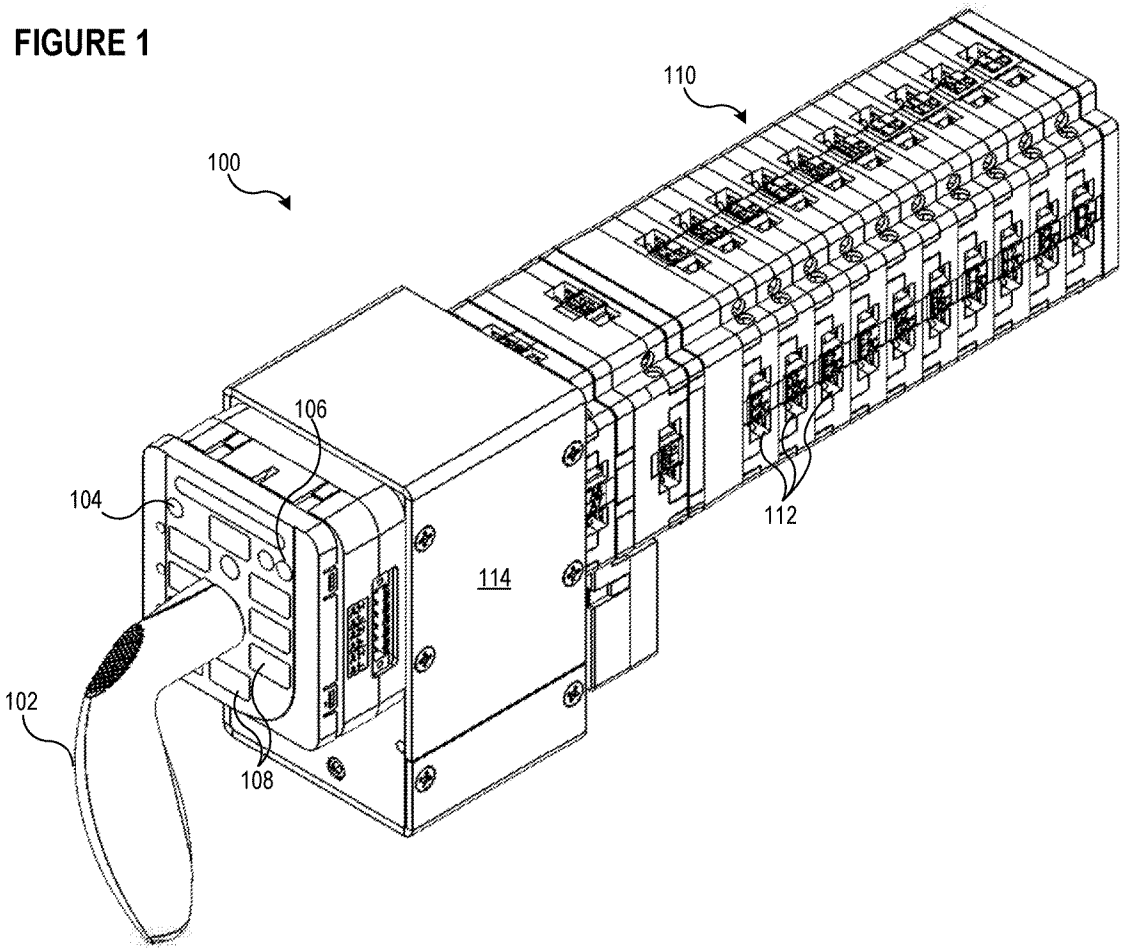
FIG. 1 illustrates a perspective view of a lockout relay device consistent with embodiments of the present disclosure.

Disclosed herein are various embodiments of lockout relay devices that may be utilized in a variety of applications. In some embodiments, a lockout relay device may be used to select between two or more positions. The positions of the lockout relay device may be used to selectively activate components (e.g., to designate a closed condition). Lockout relays may be used in electrical power systems for tripping and locking out circuit breakers or other devices automatically when a fault or other pre-determined condition exists. Lockout relays may be used in conjunction with other relays to protect transformers, buses, generators, and the like in various electrical systems. The lockout relay stays in the lockout position (e.g., an open or trip condition) until reset, either by manual action or by activation of an actuation component configured to return the device to the closed position. In various embodiments, the condition of the lockout relay device is indicated by the position of a handle and/or by one or more status indicators. In some embodiments, the status indicators may comprise visual indicators, such as light emitting diodes (LEDS). In other embodiments, a status indicator may be communicated through an electric signal to a remote operator.

A lockout relay device consistent with the present disclosure may be transitioned through two or more positions by manual or electrical actuation. In various embodiments, an event (e.g., a fault or occurrence of another condition) may cause the lockout relay device to transition to a lockout position, which may also be referred to as a trip or open position. The lockout relay may remain in the lockout position until the lockout relay device is reset. In various embodiments, the lockout relay device may be reset manually or may be reset remotely by electrical actuation. In various embodiments, the electrical actuation may be achieved by electrically activating a linear actuator. In one specific embodiment, the linear actuator may be configured to interact with a rotary arm assembly coupled to an actuator shaft. Activation of the linear actuator may cause rotation of the actuator shaft, which in turn may reset the lockout relay device.

Upon the occurrence of an event (e.g., a fault or occurrence of another condition), a lockout relay device consistent with the present disclosure may rapidly transition to the trip position. A plurality of deck devices associated with the lockout relay device may be actuated together. In some embodiments, as many as 60 contacts may be controlled by a lockout relay device. These contact may include any combination of normally closed ("NC") contacts or normally open ("NO") contacts.

Electrical power generation and distribution systems are designed to generate, transmit, and distribute electrical energy to loads. Electrical power generation and distribution systems may include equipment, such as electrical generators, electrical motors, power transformers, power transmission and distribution lines, circuit breakers, switches, buses, transmission lines, voltage regulators, capacitor banks, and the like. Such equipment may be monitored, controlled, automated, and/or protected using intelligent electronic devices ("IEDs") that receive electric power system information from the monitored equipment, make decisions based on the information, and provide monitoring, control, protection, and/or automation outputs to the monitored equipment. Provided above is an exemplary, non-exhaustive list of equipment in an electrical power generation and distribution system that may be referred to herein as monitored equipment. The term monitored equipment, as used herein, refers to any device that may be monitored, controlled, and/or automated using an IED.

An IED or other control device in an electric power system may be configured to provide a control input to a lockout relay device in some embodiments consistent with the present disclosure. A lockout relay device consistent with the present disclosure may be selectively actuated based on the control input to change a position of the lockout relay device. As a result of such a change, equipment connected to the lockout relay device may be activated, deactivated, or adjusted. In some embodiments, an IED may include, for example, remote terminal units, differential relays, distance relays, directional relays, feeder relays, overcurrent relays, voltage regulator controls, voltage relays, breaker failure relays, generator relays, motor relays, automation controllers, bay controllers, meters, recloser controls, communication processors, computing platforms, programmable logic controllers ("PLCs"), programmable automation controllers, input and output modules, governors, exciters, statcom controllers, SVC controllers, OLTC controllers, and the like. Further, in some embodiments, IEDs may be communicatively connected via a network that includes, for example, multiplexers, routers, hubs, gateways, firewalls, and/or switches to facilitate communications on the networks, each of which may also function as an IED. Networking and communication devices may also be integrated into an IED and/or be in communication with an IED. As used herein, an IED may include a single discrete IED or a system of multiple IEDs operating together.

The embodiments of the disclosure will be best understood by reference to the drawings. It will be readily understood that the components of the disclosed embodiments, as generally described and illustrated in the figures herein, could be arranged and designed in a wide variety of different configurations. Thus, the following detailed description of the embodiments of the systems and methods of the disclosure is not intended to limit the scope of the disclosure, as claimed, but is merely representative of possible embodiments of the disclosure. In addition, the steps of a method do not necessarily need to be executed in any specific order, or even sequentially, nor do the steps need to be executed only once, unless otherwise specified.

In some cases, well-known features, structures, or operations are not shown or described in detail. Furthermore, the described features, structures, or operations may be combined in any suitable manner in one or more embodiments. It will also be readily understood that the components of the embodiments, as generally described and illustrated in the figures herein, could be arranged and designed in a wide variety of configurations.

FIG. 1 illustrates a perspective view of a lockout relay device 100 consistent with embodiments of the present disclosure. A plurality of internal components may be disposed with a housing 114. The lockout relay device 100 includes a handle 102 that may be used to manually actuate the lockout relay device 100. In some embodiments, lockout relay device 100 may be configured for mounting in a rack. Lockout relay device 100 may be sized to operate in a variety of applications. In various embodiments, lockout relay device 100 may comprise a rectangular or square housing ranging in size from 1 inch per side to 20 inches per side, and all sizes there between. Lockout relay device may be formed of a variety of materials, including but not limited to non-ferrous materials, ferrous materials, ceramics, plastic, wood, or any combination on such materials Lockout relay 100 typically is configurable in two positions, namely trip and reset. A plurality of labels 108 may be disposed at various positions on the face of the lockout relay device 100. Although eight positions are illustrated, in various embodiments, fewer positions are utilized. A plurality of status indicators 104, 106 may be disposed on the face of the lockout relay device 100. In some embodiments, the status indicators 104, 106 may comprise multi-color light emitting diodes configured to provide information to a user. In one specific embodiment, status indicator 104 may be illuminated by the occurrence of a trip event, and status indicator 106 may be illuminated when the lockout relay device is in a closed position.

In the illustrated embodiment, a plurality of contact modules 110 is associated with lockout relay device 100. The contact modules 110 may be arranged in a plurality of decks. A plurality of conductors may be wired into apertures 112, and operation of lockout relay device 100 may selectively connect or disconnect the plurality of contact modules 110. The illustrated embodiment includes 15 deck devices, each of which may control four contacts. As such, the illustrated embodiment may control up to 60 contacts. In other embodiments more or fewer contacts may be controlled by a lockout relay consistent with the present disclosure.

In some embodiments, one or more deck devices may comprise an overcurrent protection element (e.g., an electrical breaker). In response to an overcurrent condition, one or more of the overcurrent protection elements may trip to prevent damage resulting from the overcurrent condition. The trip action of one or more deck devices may trip all of the associated contact modules.

Figure 2A:
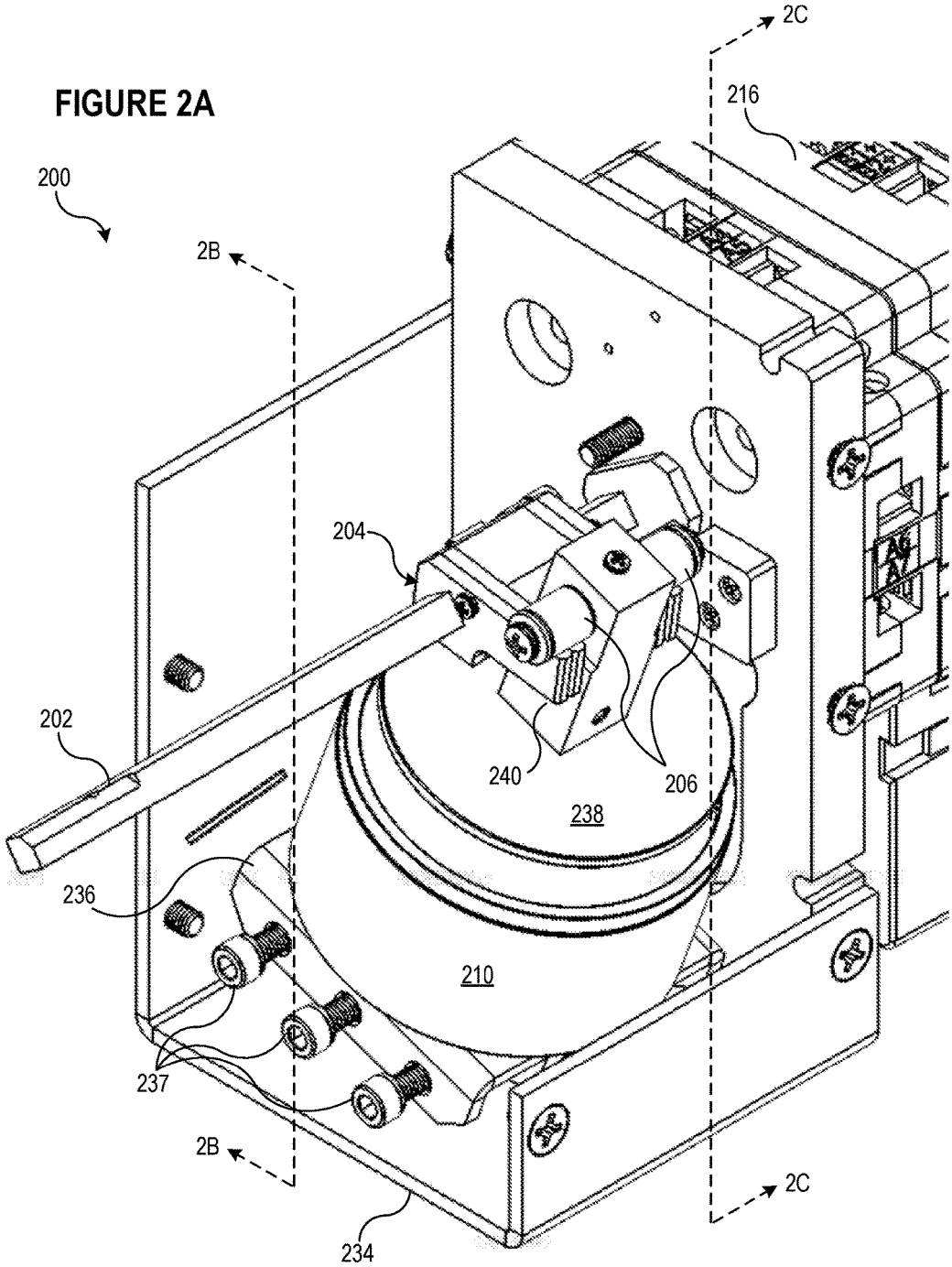
FIG. 2A illustrates a perspective view of an electrical reset module of a lockout relay device consistent with embodiments of the present disclosure.

FIG. 2A illustrates a perspective view of an electrical reset module of a lockout relay device 200 consistent with embodiments of the present disclosure. A rotary shaft 202 may be used to couple together a manual actuator (not shown) (e.g., a handle), the illustrated electrical reset module, and a plurality of deck devices 216. In the illustrated embodiment, the rotary shaft 202 comprises a unitary structure extending through the lockout relay device 200. The rotary shaft 202 may extend through a plurality of deck devices so that each deck device may actuate lockout relay device 200.

A rotary arm assembly 204 may include an aperture through which the rotary shaft 202 passes. The rotary arm may be configured such that rotation of the rotary arm assembly 204 is transferred to rotary shaft 202. A coupling component 240 is disposed on top of a linear actuator 210. Coupling component 240 may be attached to linear actuator 210, such that actuation of linear actuator 210 may be transferred to coupling component 240. In the illustrated embodiment, the coupling component 240 includes a protruding component 206 that extends over the rotary arm assembly 204. Activation of linear actuator 210 may create a downward linear force that is transferred to rotary arm assembly 204. The downward force on rotary arm assembly 204 may be translated to a clockwise rotary force on rotary shaft 202. The downward force may result in the rotary arm assembly 204 rotating in a direction toward the linear actuator 210.

In the illustrated embodiment, linear actuator 210 is coupled to a platform 238. As such, platform 238 moves in response to a movement of linear actuator 210. In other embodiments, the platform 238 may be distinct from the linear actuator 210, and the platform 238 and the linear actuator 210 may be coupled together. A base 236 on which linear actuator 210 is disposed may be angled with respect to a housing 234 of lockout relay 200. As such, linear actuator 210 and platform 238 may be disposed at an angle with respect to housing 234. In the illustrated embodiment, rotary shaft 202 may be disposed at approximately the center of the housing 234, and rotary arm assembly 204 may extend in the same direction that the linear actuator 210 is angled. The base 236 may be secured to a housing of lockout relay device 200 using a plurality of base bolts 237.

Figure 2B:
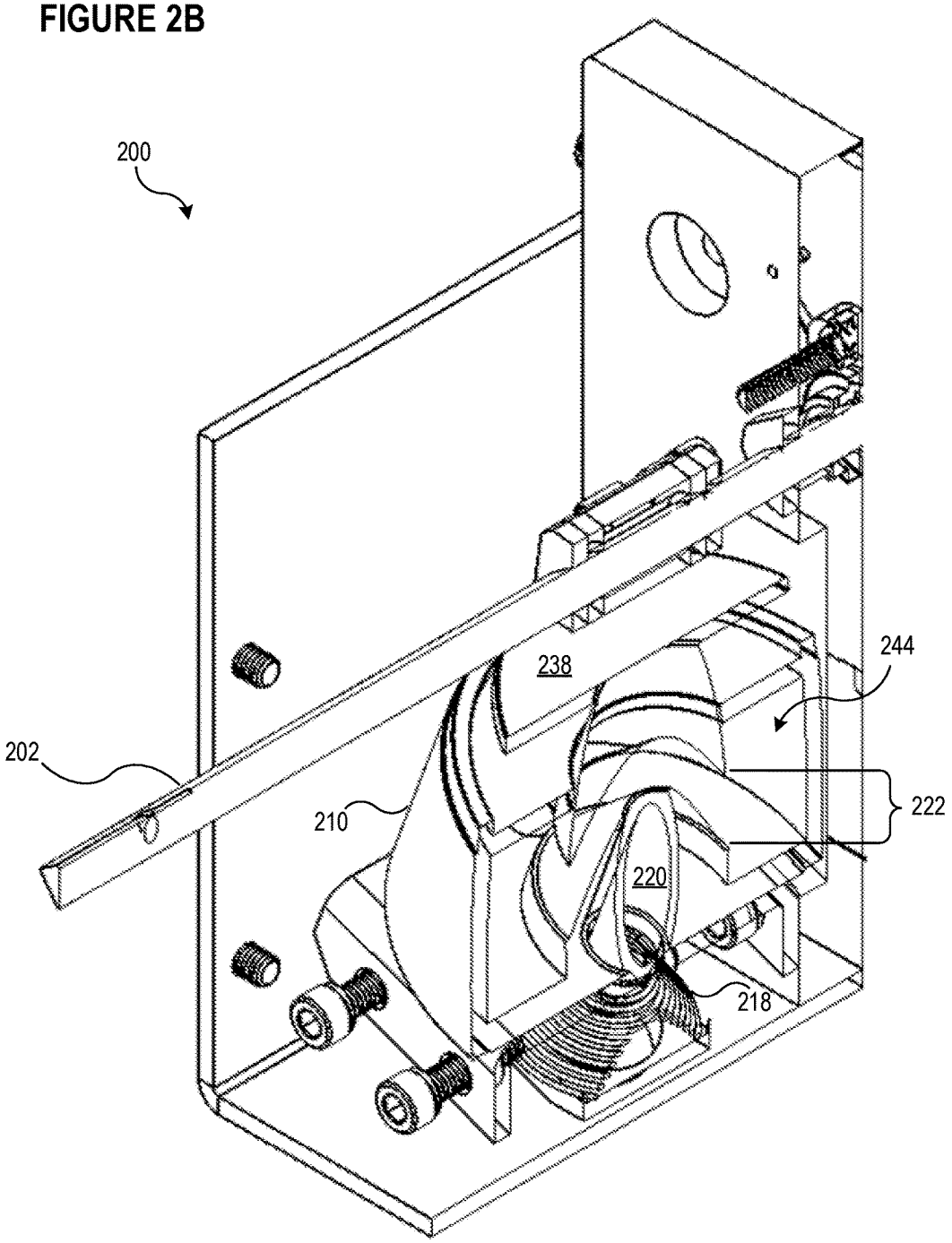
FIG. 2B illustrates a cross-sectional view of the lockout relay device illustrated in FIG. 2A and taken along line 2B-2B consistent with embodiments of the present disclosure.

FIG. 2B illustrates a cross-sectional view of the lockout relay device 200 illustrated in FIG. 2A and taken along line 2B-2B consistent with embodiments of the present disclosure. As illustrated in FIG. 2B, the rotary shaft 202 extends through the lockout relay device 200 and extends toward the deck devices. As such, rotation of the rotary shaft 202 may simultaneously actuate the deck devices 216. Similarly, an action by one or more of the deck devices (e.g., one of the deck devices tripping) may cause the lockout relay device to actuate along with all other deck devices. In response to a fault or other condition detected by one of the deck devices, lockout relay device 200 may transition to a lockout position.

A downward motion created by linear actuator 210 exerts a downward force on the actuator shaft 220 and an actuator spring 218. The downward force may cause the actuator spring 218 to compress and the platform 238 to move downward a travel distance 222. In various embodiments, the linear actuator 210 may comprise a solenoid. In such embodiments, the application of an electrical potential to the solenoid may result in linear movement of the actuator shaft 220. The solenoid may be disposed within a void 244 in linear actuator 210. Once the electrical potential is discontinued, actuator spring 218 may exert a restoring force that causes platform 238 to an original position (i.e., the position platform 238 occupied prior to actuation of linear actuator 210).

Figure 2C:
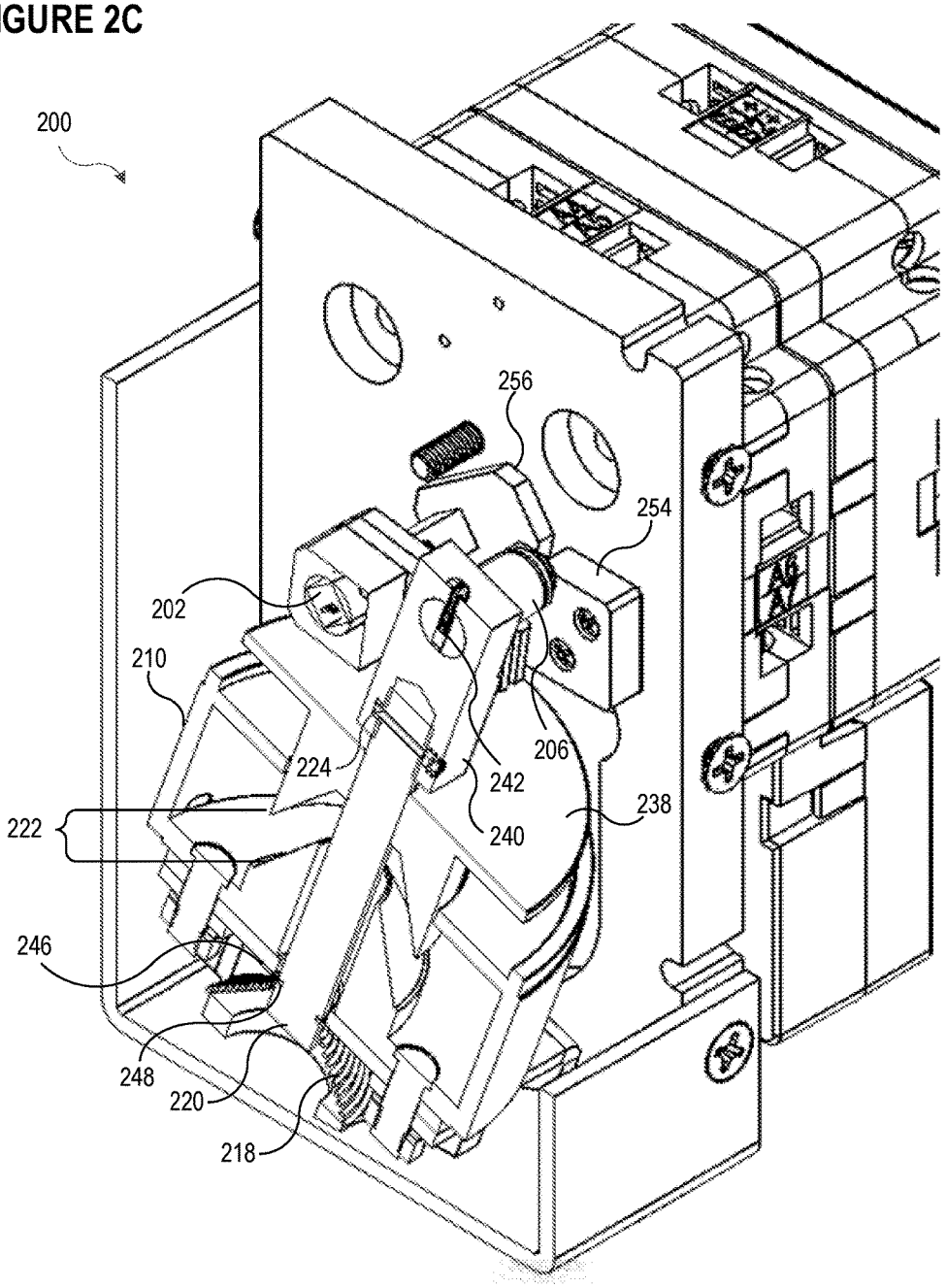
FIG. 2C illustrates a cross-sectional view of the lockout relay device illustrated in FIG. 2A and taken along line 2C-2C.

FIG. 2C illustrates a cross-sectional view of lockout relay device 200 as illustrated in FIG. 2A and taken along line 2C-2C. As illustrated in FIG. 2C, actuator shaft 220 extends from actuator spring 218 to platform 238. A downward force may cause the actuator spring 218 to compress and the platform 238 to move downward a travel distance 222. An actuator shaft coupling pin 224 may secure the actuator shaft 220 to the coupling component 240. Similarly, protruding component 206 may be secured to coupling mechanism 240 using a protruding component coupling pin 242.

The range of rotational movement of the rotation of rotary shaft 202 may be limited. In the counterclockwise direction, the rotational range of rotary shaft 202 may be limited by the protruding component 206. In the clockwise direction, the range of rotational movement may be limited by the interaction of a receiving component 254 and an extension component 256. In the illustrated embodiment, receiving component 254 is coupled to a rear face of the lockout relay housing. Extension component 256 is coupled to the rotary shaft 202. The interaction of the receiving component 254 and extension component 256 is illustrated and described in greater detail in connection with FIGS. 3A-3C.

Actuator spring 218 may be configured to maintain lockout relay device 200 in the illustrated configuration in the absence of a force exerted by linear actuation component 210. The range of downward movement of the platform 238 may be limited by physical interaction between the platform 238 and the linear actuation component 210. The range of upward movement of the platform 228 may be limited by an actuation shaft stopper 246. In the illustrated embodiment, actuation shaft stopper 246 may comprise a C-shaped washer configured to be received within a retention groove 248 disposed on actuator shaft 220.

Figure 3A:
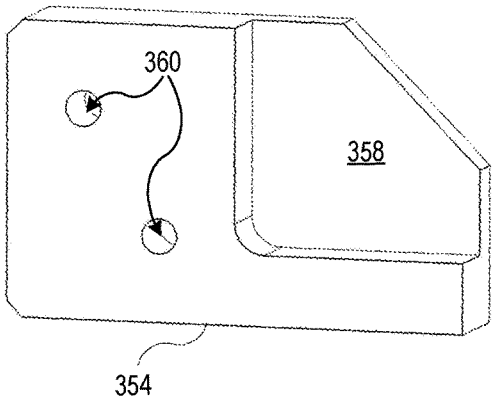
FIG. 3A illustrates a perspective view of a receiving component operable in conjunction with an extension component and configured to limitation rotation of a rotary shaft in a lockout relay device consistent with embodiments of the present disclosure.
Figure 3B:
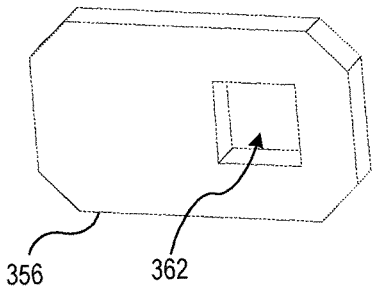
FIG. 3B illustrates a perspective view of an extension component operable in conjunction with the receiving component illustrated in FIG. 3A and configured to limit rotation of a rotary shaft in a lockout relay device consistent with embodiments of the present disclosure.

FIG. 3A illustrates a perspective view of a receiving component 354 operable in conjunction with an extension component 356 illustrated in FIG. 3B and configured to limit rotation of a rotary shaft (not shown) in a lockout relay device consistent with embodiments of the present disclosure. As discussed above, in various embodiments it may be desirable to limit the range of rotation of the rotary shaft (not shown). In one embodiment, receiving component 354 may be disposed within a housing of a lockout relay device and configured to receive an extension coupled to a rotary shaft in a notch 358. A plurality of apertures 360 may be used to secure receiving component 354 within the housing of the lockout relay device. In various embodiments, screws, pins, rivets, or fasteners of other types may be utilized.

FIG. 3B illustrates a perspective view of extension component 356, which is operable in conjunction with receiving component 354 illustrated in FIG. 3A and configured to limit the rotation of a rotary shaft in a lockout relay device consistent with embodiments of the present disclosure. Extension 356 may include an aperture 362 configured to couple to the rotary shaft (not shown). The coupling of the rotary shaft with aperture 362 may cause extension 356 to rotate in unison with the rotary shaft.

Figure 3C:
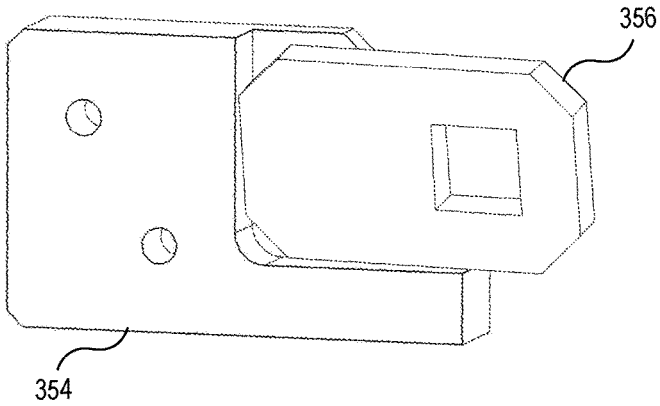
FIG. 3C illustrates an interaction between the receiving component illustrated in FIG. 3A and the extension component illustrated in FIG. 3B to limit rotation of a rotary shaft in a lockout relay device consistent with embodiments of the present disclosure.

FIG. 3C illustrates an interaction between the receiving component 354 illustrated in FIG. 3A and the extension component 356 illustrated in FIG. 3B to limit rotation of a rotary shaft in a lockout relay device consistent with embodiments of the present disclosure. As illustrated in FIG. 3C, extension component 356 may be received within notch 358. The interaction between receiving component 354 and extension component 356 may prevent rotation of the rotary shaft beyond a specific range in one direction. In some embodiments, the rotation of the rotary shaft may be limited in the other direction such that receiving component 354 always remains within the area defined by notch 358.

Figure 3D:
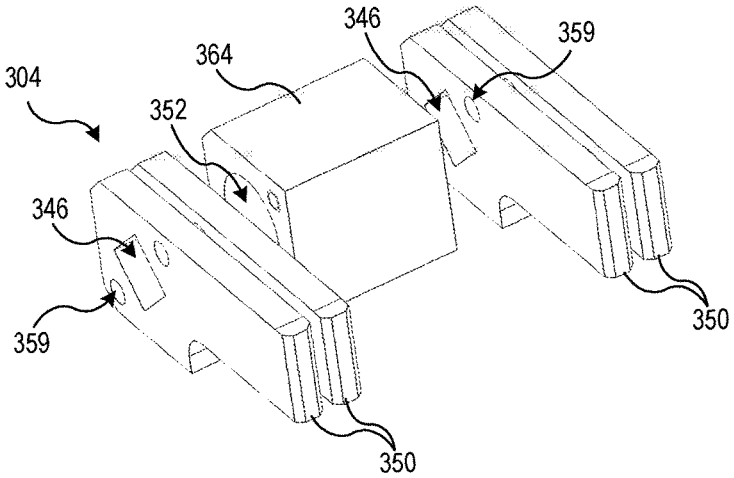
FIG. 3D illustrates an exploded view of a rotary arm assembly consistent with embodiments of the present disclosure.

FIG. 3D illustrates an exploded view of a rotary arm assembly 304 consistent with embodiments of the present disclosure. In the illustrated embodiment, rotary arm assembly 304 includes two pairs of rotary arms 350 separated by a spacer component 364. In other embodiments, a single rotary arm may be used in place of the illustrated pairs of rotary arms. Similarly, although two pairs or rotary arms are shown, in other embodiments, only a single pair of rotary arms may be used. Each rotary arm 350 may include an aperture 346 configured to couple each rotary arm 350 to a rotary shaft (not shown). In the illustrated embodiment, aperture 346 is approximately square; however, other shapes may be used in alternative embodiments. The rotary shaft may pass through an aperture 352 in spacer component 364. In the illustrated embodiment, aperture 352 is circular. In other embodiments, aperture 352 may have the same shape as the rotary shaft. A plurality of apertures 359 may be used to assemble the constituent components of rotary arm assembly 304. Screws, pins, rivets, or fasteners of other types may secure the components rotary arm assembly 304 together.

Figure 4A:
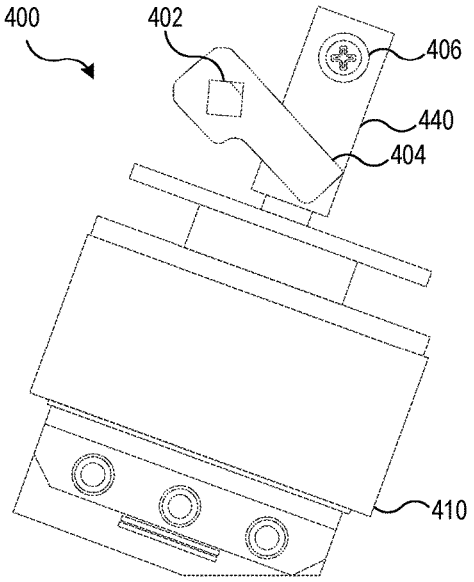
FIG. 4A illustrates the position of a lockout mechanism associated with a lockout relay device disposed in a closed position prior to a fault consistent with embodiments of the present disclosure.

FIG. 4A illustrates the position of a lockout mechanism 400 associated with a lockout relay device disposed in a closed position prior to a fault consistent with embodiments of the present disclosure. A plurality of deck devices (not shown) may be coupled to rotary shaft 402. In the closed position, the deck devices may be configured to permit the flow of electrical current to a variety of associated devices.

Figure 4B:
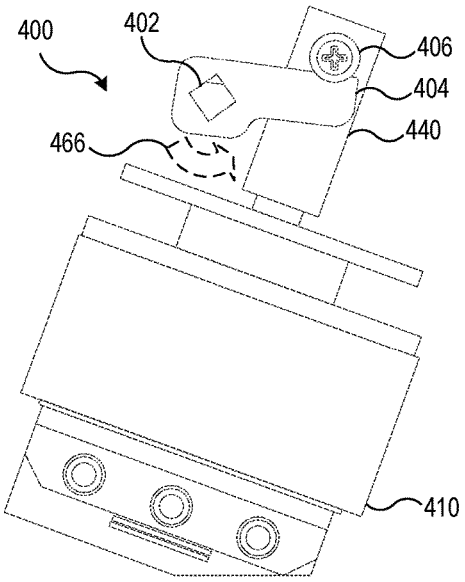
FIG. 4B illustrates the position of the lockout mechanism of FIG. 4A in a lockout position following a fault consistent with embodiments of the present disclosure.

FIG. 4B illustrates the position of the lockout mechanism 400 of FIG. 4A in a lockout position following a fault consistent with embodiments of the present disclosure. Upon the occurrence of the fault, one or more deck devices affected by the fault may exert a rotational force on the rotary arm 404 in the direction indicated by arrow 466. As rotary shaft 402 rotates, rotary arm 404 may come into contact with a protruding component 406. The interaction between rotary arm assembly 404 and protruding component 406 may prevent further rotation of rotary shaft 402. The interaction between rotary arm assembly 404 and protruding component 406 may limit the rotational range of the rotary shaft 402 in the counterclockwise direction in the illustrated embodiment. In the lockout position, the deck devices may be in an open position. In the open or trip position, the deck devices may be configured to prevent the flow of electrical current. A fault associated with one deck device may cause all of the deck devices associated with lockout mechanism 400 to transition from the closed position to the open or trip position. The lockout mechanism 400 may remain in the lockout configuration illustrated in FIG. 4B until it is reset, either manually or by activation of the linear actuation component 410.

Figure 4C:
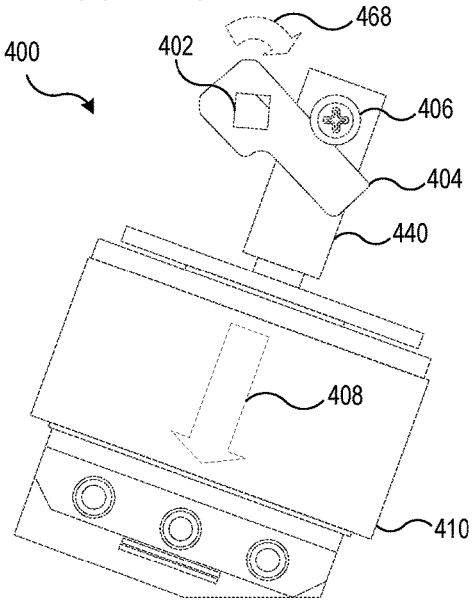
FIG. 4C illustrates the position of the lockout mechanism of FIG. 4B during a reset operation performed by a linear actuation component consistent with embodiments of the present disclosure.

FIG. 4C illustrates the position of the lockout mechanism 400 of FIG. 4B during a reset operation initiated by linear actuation component 410 consistent with embodiments of the present disclosure. The reset operation illustrated in FIG. 4C is performed by activating linear actuation component 410. Activation of linear actuation component 410 results in a force in the direction indicated by arrow 408. In various embodiments, the force in the direction indicated by arrow 408 may be generated by a solenoid disposed within linear actuation component 410. In various embodiments, activation of linear actuation component 410 may compress a biasing component, such as actuator spring 218 illustrated in FIGS. 2B and 2C.

Returning to a discussion of FIG. 4C, the downward force created by linear actuation component 410 is translated by rotary arm assembly 404 to a rotational force in the direction indicated by arrow 468. The rotation restores the rotary shaft 402 to the same position illustrated in FIG. 4A, and thus the plurality of deck devices coupled to the rotary shaft 402 may be returned to the closed position.

Figure 4D:
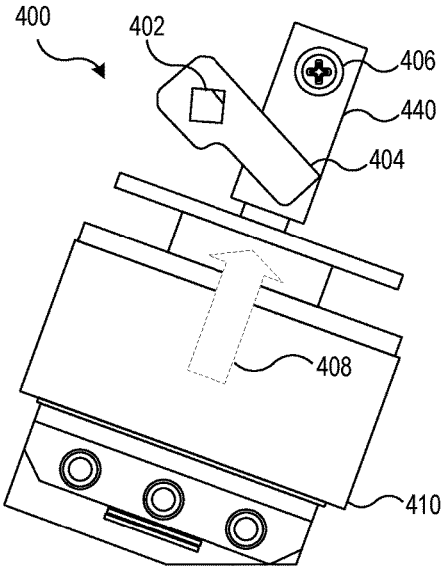
FIG. 4D illustrates the position of the lockout mechanism following a return of a linear actuation component to an original position upon completion of the reset operation illustrated in FIG. 4C consistent with embodiments of the present disclosure.

FIG. 4D illustrates the position of the lockout mechanism 400 following a return of a linear actuation component 410 to an original position upon completion of the reset operation illustrated in FIG. 4C consistent with embodiments of the present disclosure. After the reset operation is complete, linear actuation component 410 may be deactivated and the force in FIG. 4B shown by arrow 408 may dissipate. A biasing component (e.g., an actuator spring) may exert a force in the direction indicated by arrow 408. The force in the direction indicated by arrow 408 may cause protruding component 406 and coupling component 440 to return to the original positions shown in FIG. 4A. The cycle illustrated in FIGS. 4A-4D may be repeated any number of times in response to faults or other conditions associated with the plurality of deck devices.

As may be appreciated, the reset operation of lockout mechanism 400 illustrated in FIGS. 4C and 4D may also be performed manually. Specifically with reference to FIG. 4B, a handle (not shown) coupled to rotary shaft 402 may be rotated by an operator in the clockwise direction. Rotation of the handle restores the rotary shaft 402 to the same position illustrated in FIG. 4A. As such, the plurality of deck devices coupled to the rotary shaft 402 may be returned to the closed position.

Figure 5B:
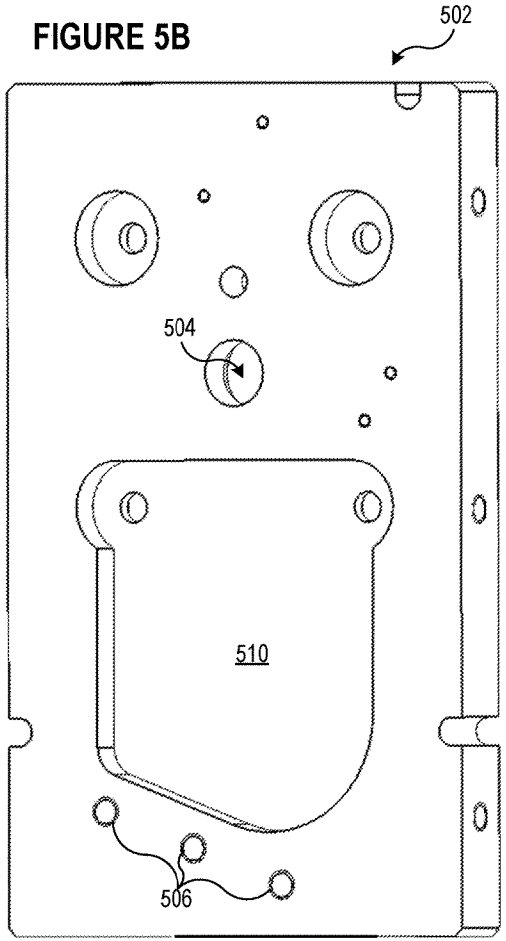
FIG. 5B illustrates a rear panel of a housing of a lockout relay device consistent with embodiments of the present disclosure.
Figure 5A:
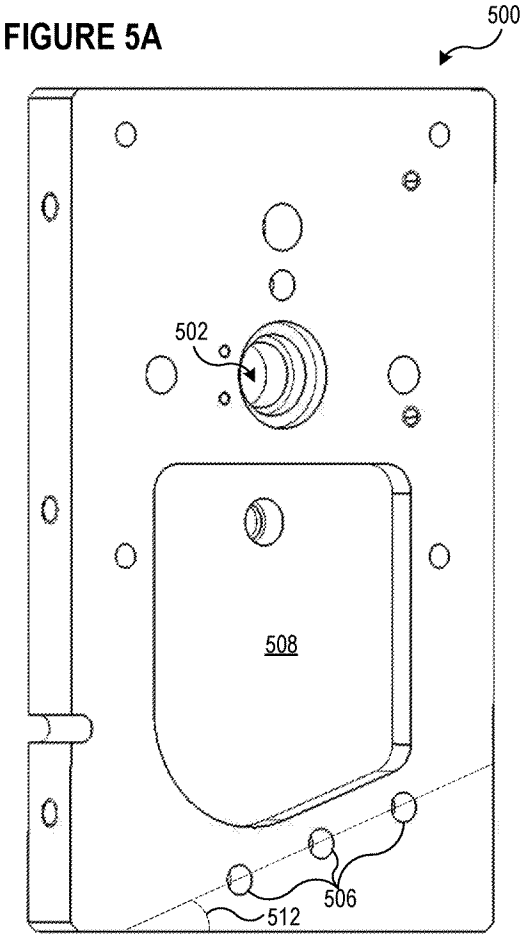
FIG. 5A illustrates a front panel of a housing of a lockout relay device consistent with embodiments of the present disclosure.

FIG. 5A illustrates a front panel 500 of a housing of a lockout relay device consistent with embodiments of the present disclosure. FIG. 5B illustrates a rear panel 502 of a housing of a lockout relay device consistent with embodiments of the present disclosure. Front panel 500 and rear panel 502 may include various features associated with structures or functions described herein. A rotary shaft aperture 502 in front panel 500 and a rotary shaft aperture 504 in rear panel 502 may permit a rotary shaft (not shown) to extend through the housing of the lockout relay device. In various embodiments, a linear actuation component (not shown) is disposed at an angle with respect to the housing. A plurality of apertures 506 may permit a base to be secured to front panel 500 and rear panel 502. A base secured using apertures 506 may be disposed at an angle 512 with respect to the bottom of the housing of the lockout relay device. As illustrated in FIGS. 2B and 2C, a linear actuation component (not shown) disposed on top of the base is similarly angled with respect to the housing. A recess 508 disposed in front panel 500 and a recess 510 disposed in rear panel 502 may accommodate and/or support the linear actuation component.

It will be understood by those having skill in the art that many changes may be made to the details of the above-described embodiments without departing from the underlying principles of the invention. For example, any suitable combination of various embodiments disclosed herein, or the features, elements, or components thereof, is contemplated, irrespective of whether such features, elements, or components are explicitly disclosed as being part of a single exemplary embodiment.

It should also be understood that terms such as "right," "left," "top," "bottom," "above," and "side," as used herein, are merely for ease of description and refer to the orientation of the components as shown in the figures. It should be understood that any orientation of the components described herein is within the scope of the present disclosure.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, inventive aspects lie in a combination of fewer than all features of any single foregoing disclosed embodiment.

A variety of modifications in and to the embodiments and implementations disclosed herein will be apparent to those persons skilled in the art. Accordingly, no limitation on the invention is intended by way of the foregoing description and accompanying drawings, except as set forth in the appended claims.

The invention claimed is:

1. A rotary lockout relay device configured to transition from a lockout position to a closed position in response to one of a manual adjustment and a reset operation, the lockout relay device comprising:

a rotary shaft configured to rotate between a first rotational position corresponding to the closed position and a second rotational position corresponding to the lockout position;

a manual actuator coupled to the rotary shaft and configured to permit a manual transition of the lockout relay device from the lockout position to the closed position;

a linear actuation component configured to initiate a reset operation by generation of a linear motion;

a lockout mechanism configured to translate the linear motion of the linear actuation component to a rotational motion of the rotary shaft and to cause the lockout relay device to transition from the lockout position to the closed position, the lockout mechanism comprising:

a coupling component affixed to the linear actuation component;

a protruding component extending from the coupling component;

a rotational arm coupled to the rotary shaft;

wherein the rotational arm is in contact with the protruding component only in the lockout position, and the linear motion causes the protruding component to exert a force on the rotational arm, and the force results in rotation of the rotary shaft from the second position to the first position.

2. The rotary lockout relay device of claim 1, wherein the linear actuation component comprises a solenoid.

3. The rotary lockout relay device of claim 1, wherein the linear motion causes the rotational arm to rotate in a direction toward the linear actuation component.

4. The rotary lockout relay device of claim 1, further comprising a spring configured to compress in response to the linear motion and to exert a restoring force configured to cause the coupling component and protruding component to return to an original position upon termination of the linear motion.

5. The rotary lockout relay device of claim 1, wherein rotation of the rotary shaft in a first direction is restricted by a first rotation limitation component and rotation of the rotary shaft in a second direction is restricted by a second rotation limitation component.

6. The rotary lockout relay device of claim 5, wherein one of the first rotation limitation component and the second rotation limitation component comprises the protruding component.

7. The rotary lockout relay device of claim 1, wherein the linear actuation component is disposed at an angle with respect to a housing of the lockout relay device.

8. The rotary lockout relay device of claim 1, wherein the rotary shaft is configured to actuate a plurality of rotary deck devices.

9. The rotary lockout relay device of claim 1, wherein the plurality of deck devices comprise a plurality of contact modules.

10. A rotary lockout relay device configured to transition from a lockout position to a closed position only in response to one of a manual adjustment and a reset operation, the lockout relay device comprising:

a housing;

a linear electrical actuator disposed within the housing and at an angle with respect to the housing, the linear electrical actuator configured to generate a linear motion upon electrical activation;

a rotary shaft coupled to the lockout mechanism;

a lockout mechanism coupled to the rotary shaft and configured to:

cause the lockout relay device to transition to the lockout position based on an action in response to an electrical condition;

cause the lockout relay device to remain in the lockout position until the occurrence of a reset operation initiated by activation of the linear electrical actuator; and cause the lockout relay device to transition from the lockout position to the closed position in response to the reset operation based on the linear motion of the linear electrical actuator;

wherein the lockout mechanism is in contact with the linear electrical actuator only in the lockout position and the linear motion of the linear electrical actuator is translated to a rotational motion of the rotary shaft due to the angle of the linear electrical actuator with respect to the housing.

11. The rotary lockout relay device of claim 10, wherein the electrical condition comprises an electrical fault.

12. The rotary lockout relay device of claim 10, wherein the rotary shaft is further configured to transition at least one deck device from a closed position to a lockout position in response to the electrical condition.

13. The rotary lockout relay device of claim 10, wherein a first rotational position of the rotary shaft corresponds to the closed position and a second rotational position of the rotary shaft corresponds to the lockout position.

14. The rotary lockout relay device of claim 10, wherein rotation of the rotary shaft in a first direction is restricted by a first rotation limitation component and rotation of the rotary shaft in a second direction is restricted by a second rotation limitation component.

15. The rotary lockout relay device of claim 14, wherein the first rotation limitation component is coupled to the housing and the second rotation limitation component is coupled to the linear electrical actuator.

16. The rotary lockout relay device of claim 10, wherein the linear electrical actuator comprises a solenoid.

17. The rotary lockout relay device of claim 10, further comprising a rotary arm coupled to the rotary shaft, the rotary arm configured to translate the linear motion to a rotational motion.

18. The rotary lockout relay device of claim 17, wherein the linear motion causes the rotational arm to rotate in a direction toward the linear actuation component.

19. The rotary lockout relay device of claim 10, further comprising a spring configured to compress in response to the linear motion and to exert a restoring force configured to cause the linear electrical actuator to return to an original position upon termination of the linear motion.

20. A rotary lockout relay device configured to transition from a lockout position to a closed position in response to one of a manual adjustment and a reset operation, the lockout relay device comprising:

a housing;

a rotary shaft configured to rotate between a first rotational position corresponding to the closed position and a second rotational position corresponding to the lockout position;

an electrical actuator disposed within the housing and at an angle with respect to the housing, the electrical actuator configured to generate a motion upon electrical activation;

a lockout mechanism configured to:

cause the lockout relay to transition to the lockout position based on an action in response to an electrical condition;

cause the rotary shaft to rotate and to transition from the closed position to the second rotational position in response to the electrical condition;

cause the lockout relay device to remain in the lockout position until the occurrence of a reset operation initiated by activation of the electrical actuator;

cause the lockout relay device to transition from the lockout position to the closed position in response to the reset operation based on the motion of the electrical actuator; and cause the rotary shaft to rotate and to transition from the second rotational position to the closed position in response to the reset operation;

wherein the lockout mechanism is in contact with the electrical actuator only in the lockout position and the motion of the electrical actuator is translated to a rotational motion of the rotary shaft due to the angle of the electrical actuator with respect to the housing.

* * * * *